US006819897B2

(12) United States Patent
Kita

(10) Patent No.: US 6,819,897 B2
(45) Date of Patent: Nov. 16, 2004

(54) IMAGE FORMING APPARATUS FOR REDUCING A FREQUENCY OF TONER CONTAINER EXCHANGE, AND ASSOCIATED METHOD OF MANUFACTURE

(75) Inventor: Emi Kita, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/412,391

(22) Filed: Apr. 14, 2003

(65) Prior Publication Data

US 2003/0215268 A1 Nov. 20, 2003

(30) Foreign Application Priority Data

Apr. 12, 2002 (JP) ..... 2002-110526

(51) Int. Cl.[7] ..... G03G 15/01; G03G 15/08

(52) U.S. Cl. ..... 399/223; 399/120; 399/258; 399/302

(58) Field of Search ..... 399/223, 224, 399/258, 262, 119, 120, 298, 299, 302

(56) References Cited

U.S. PATENT DOCUMENTS 6,449,451 B2 * 9/2002 Tsuruya et al. ..... 399/223
2003/0016966 A1 * 1/2003 Hattori et al. ..... 399/258
2003/0147678 A1 * 8/2003 Ozawa et al. ..... 399/302
2003/0165346 A1 * 9/2003 Yamaguchi et al. ..... 399/223

FOREIGN PATENT DOCUMENTS

| | | |
|---|---|---|
| JP | 11-143328 | 5/1999 |
| JP | 2001-183886 | 7/2001 |
| JP | 2001-265088 | * 9/2001 |
| JP | 2001-305843 | 11/2001 |
| JP | 2002-229297 | * 8/2002 |

* cited by examiner

*Primary Examiner*—Sophia S. Chen
(74) *Attorney, Agent, or Firm*—Oblon, Spivak, McClelland, Maier & Neustadt, P.C.

(57) ABSTRACT

An image forming apparatus and associated method is provided and includes plural image forming mechanisms. Each forming mechanism includes an image carrying member, a development mechanism, and a toner storage. The image carrying member carries an electrostatic latent image. The development mechanism develops the electrostatic latent image into a visual image. The intermediate transfer member sequentially receives toner images into a composite toner image and transfers the composite toner image to a recording sheet. The toner storages have an approximately rectangular shape having a rectangular transverse section. At least one of the toner storages has a greater toner capacity than others of the toner storages, and a length of a short side of the rectangular transverse section of the toner storages having the greater toner capacity is approximately equal to lengths of long sides of the rectangular transverse sections of the others of the toner storages.

15 Claims, 9 Drawing Sheets

IMAGE FORMING APPARATUS FOR REDUCING A FREQUENCY OF TONER CONTAINER EXCHANGE, AND ASSOCIATED METHOD OF MANUFACTURE

BACKGROUND OF THE INVENTION

The present invention relates to an image forming apparatus, and more particularly to an image forming apparatus capable of reducing a frequency of exchanging a toner container by efficiently using a dead space for a large capacity toner storage. The present invention also relates to a method of manufacturing the above-mentioned image forming apparatus.

Conventionally, an electrophotographic image forming apparatus uses a development mechanism which develops an electrostatic latent image formed on an image carrying member into a visual image. In particular, an electrophotographic image forming apparatus using a two-component developer for the development mechanism adopts a specific structure in which a toner storage such as a toner bottle, a toner cartridge, a toner tank, and the like is arranged close to the development mechanism and toner is transported with a transportation mechanism such as an auger.

In addition, an electrophotographic image forming apparatus provided with color capability is known to employ four development mechanisms with four toner storages for colors of yellow, magenta, cyan, and black.

It is a general requirement for such an image forming apparatus to have a compact size without sacrificing a capacity of the toner storage. However, the toner storage is needed to be arranged close to the development mechanism in an engine of the image forming apparatus and therefore the miniaturization of the engine is not freely carried out and is limited to a certain level. Accordingly, flexibility of a machine design itself is constrained.

Japanese Laid-Open Patent Application Publication, No. 2001-305843, describes an image forming apparatus which has a toner storage arranged in a separate unit from a development mechanism since the toner contained in the toner storage is transported to the development mechanism with a screw pump called a mohno-pump.

However, as a recent trend, the image forming apparatus has been reduced in size, and consequently decreases an amount of dead space left therein which can be used to install the separate unit of the toner storage. Conversely, the toner capacity required to be as great as possible because an exchange of the toner storage is preferably performed as infrequently as possible. Further, in a case of a color image forming apparatus, the capacity of a black color toner is generally required to be greater than other colors because the black color toner is consumed to a greater degree than other toners.

BRIEF SUMMARY OF THE INVENTION

In view of the foregoing, it is an object of the present invention to provide a novel image forming apparatus which can store a large capacity of toner without sacrificing the reduction in size of the print engine.

Another object of the present invention is to provide a novel image forming method which can store a large capacity of toner without sacrificing the reduction in size of the print engine.

To achieve the above-mentioned object, in one example, a novel image forming apparatus includes a plural sets of image forming mechanisms and an intermediate transfer member. Each of the plural sets of image forming mechanisms includes an image carrying member, a development mechanism, and a toner storage. The image carrying member is configured to carry an electrostatic latent image thereon. The development mechanism is configured to develop the electrostatic latent image formed on the image carrying member into a visual image. The toner storage is detachably installed in the apparatus and is configured to store toner therein. The intermediate transfer member is configured to sequentially receive toner images formed by the plurality of image forming mechanisms into a composite toner image and to transfer the composite toner image to a recording sheet. In this apparatus, a plurality of the toner storages have an approximately rectangular shape having a rectangular transverse section. Further, at least one of the plurality of the toner storages has a greater toner capacity than others of the plurality of the toner storages, and a length of a short side of the rectangular transverse section of the at least one of the plurality of the toner storages having the greater toner capacity is approximately equal to lengths of long sides of the rectangular transverse sections of the others of the plurality of the toner storages.

The plurality of the toner storages may be aligned such that the short side of the rectangular transverse section of the at least one of the plurality of the toner storages and the long sides of the rectangular transverse sections of the others of the plurality of the toner storages are arranged parallel to each other.

Each of the plurality of the image forming mechanisms may further include a toner replenishing mechanism including a screw pump transporting with a negative pressure the toner from the corresponding toner storage to the corresponding development mechanism. In this case, each of the at least one of the plurality of the toner storages having the greater toner capacity is provided with a single air pump discharging a jet air to an inside of the corresponding toner storage and the others of the plurality of the toner storages are provided with a common air pump discharging a jet air to an inside of the toner storages.

The toner storage included in the at least one of the plurality of the toner storages having the greater toner capacity may be divided into a plurality of toner containers.

The plurality of toner containers divided from the toner storage and the others of the plurality of the toner storages may have a substantially common size and an approximately rectangular shape having a rectangular transverse section.

Further, to achieve the above-mentioned object, in one example, a novel method of making an image forming apparatus includes the steps of providing and placing. The providing step provides a plural sets of image forming mechanisms. Each of the plural sets of image forming mechanisms includes an image carrying member, a development mechanism, and a toner storage. The image carrying member is configured to carry an electrostatic latent image thereon. The development mechanism is configured to develop the electrostatic latent image formed on the image carrying member into a visual image. The toner storage is detachably installed in the apparatus and is configured to store toner therein. The placing step places an intermediate transfer member configured to sequentially receive toner images formed by the plurality of image forming mechanisms into a composite toner image and to transfer the composite toner image to a recording sheet. In this method, a plurality of the toner storages have an approximately rectangular shape having a rectangular transverse section.

Further, at least one of the plurality of the toner storages has a greater toner capacity than others of the plurality of the toner storages, and a length of a short side of the rectangular transverse section of the at least one of the plurality of the toner storages having the greater toner capacity is approximately equal to lengths of long sides of the rectangular transverse sections of the others of the plurality of the toner storages.

The plurality of the toner storages may be aligned such that the short side of the rectangular transverse section of the at least one of the plurality of the toner storages and the long sides of the rectangular transverse sections of the others of the plurality of the toner storages are arranged parallel to each other.

Each of the plurality of the image forming mechanisms may further include a toner replenishing mechanism including a screw pump transporting with a negative pressure the toner from the corresponding toner storage to the corresponding development mechanism. In this case, each of the at least one of the plurality of the toner storages having the greater toner capacity is provided with a single air pump discharging a jet air to an inside of the corresponding toner storage and the others of the plurality of the toner storages are provided with a common air pump discharging a jet air to an inside of the toner storages.

The toner storage included in the at least one of the plurality of the toner storages having the greater toner capacity may be divided into a plurality of toner containers.

The plurality of toner containers divided from the toner storage and the others of the plurality of the toner storages may have a substantially common size and an approximately rectangular shape having a rectangular transverse section.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE INVENTION

Figure 1:
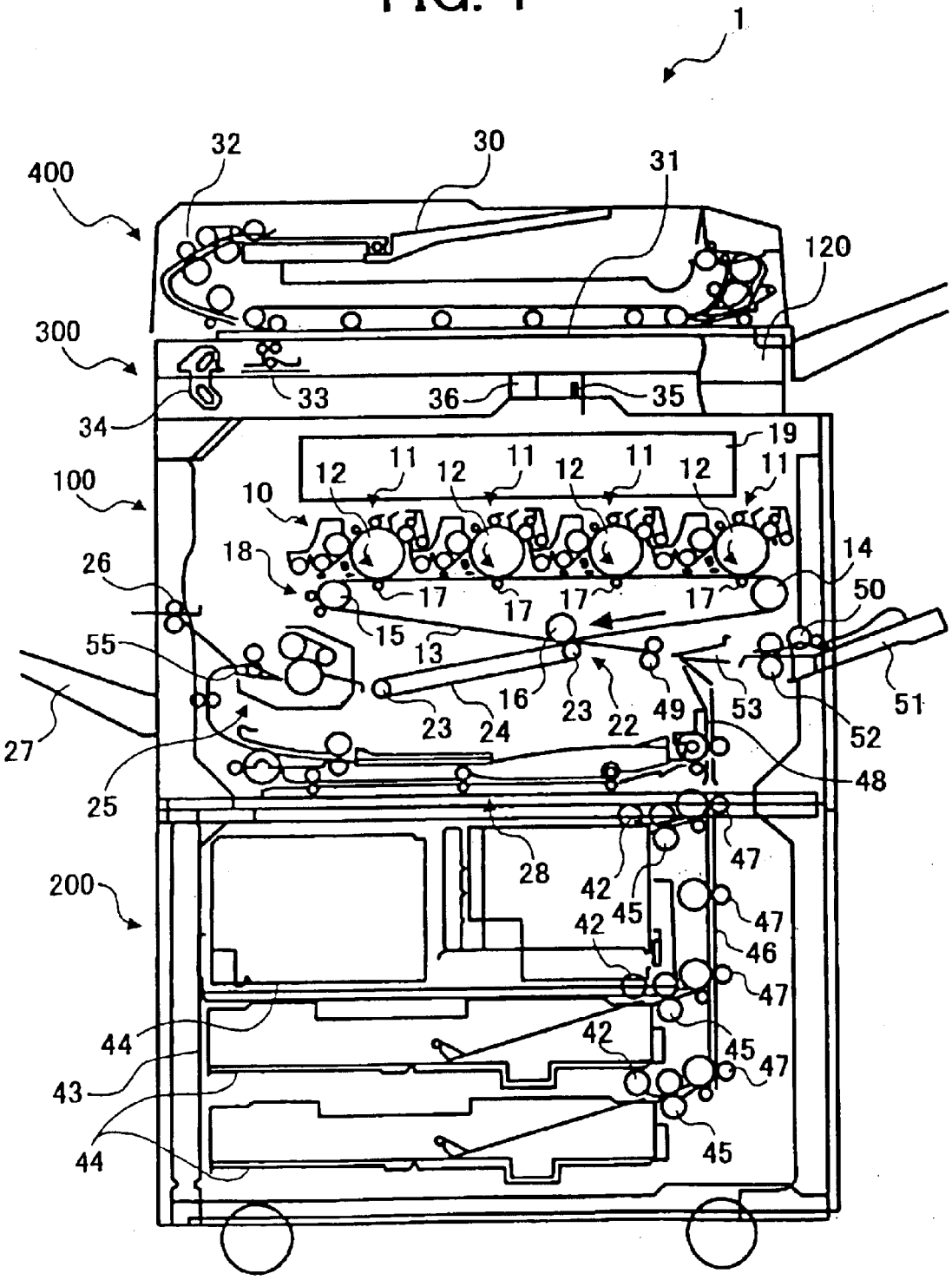
FIG. 1 is a schematic diagram of a color copying apparatus according to an exemplary embodiment of the present invention.

In describing the exemplary preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner.

Referring now to the drawings, wherein like reference numerals designate identical or corresponding parts throughout the several views, particularly to FIG. 1, a color copying apparatus 1 is explained, which is one example of a color image forming apparatus according to a preferred embodiment of the present invention. The color copying apparatus 1 forms an image using an electrophotographic method and, as shown in FIG. 1, includes a color copying engine 100 at the middle, a sheet supply station 200 at the bottom, and an image scanner 300 at the top of the color copying apparatus 1 with an automatic document feeder (ADF) 400 on top. In addition, the color copying apparatus 1 is also provided with an operation panel 120 in front of and in an integrated form with the image scanner 300. Those skilled in the art will recognize that the above components may be located at alternative positions within the apparatus in addition to those mentioned above.

The color copying engine 100 is provided with a tandem mechanism 10 including four image forming units 11 arranged horizontally for black (Bk), cyan (C), magenta (M), and yellow (Y) colors. Each of the four image forming units 11 includes a photosensitive drum 12 which serves as a primary image carrying member for carrying a latent image formed thereon. Around the photosensitive drum 12, various requisite mechanisms for the electrophotographic process, as explained herein.

Below the tandem mechanism 10, an intermediate transfer belt 13 is extended under a predetermined tension among a plurality of rollers 14, 15, and 16, and is arranged to contact the four photosensitive drums 11. The intermediate transfer belt 13 includes a flexible endless belt and serves as a secondary image carrying member for carrying a toner image. One of the rollers 14, 15, and 16 is driven to rotate the intermediate transfer belt 13 clockwise, as indicated by an arrow. Other rollers which are not directly driven follow the rotation.

The color copying engine 100 is further provided with four primary image transfer units 17 which contact an inside surface of the intermediate transfer belt 13 at positions to face the respective photosensitive drums 12 via the intermediate transfer belt 13. Reference numeral 18 denotes a cleaning unit for removing unused toner particles from the intermediate transfer belt 13.

Above the tandem mechanism 10, an exposure unit 19 for sequentially irradiating each of the photosensitive drums 11 with an optically-modulated laser beam is provided. The exposure is performed at an area after a charging process and before a development process. Instead of the single exposure unit 19, four separate exposure units may be provided to be used on a one-to-one basis relative to each of the photosensitive drums 11. In the exemplary embodiment, the single exposure unit 19 is utilized to decrease cost.

Underneath the intermediate transfer belt 13, a secondary image transfer unit 22 is provided. The secondary image transfer unit 22 includes a secondary image transfer belt 24 which is an endless belt and is extended between two rollers 23. The secondary image transfer unit 22 is arranged such that a portion of the secondary image transfer belt 24 close to one of the rollers 23 presses the intermediate transfer belt 13 against the roller 16. Near the other one of the rollers 23 and below the roller 15, a fixing unit 25 for fixing a toner image carried by and on a recording sheet is provided.

The secondary image transfer unit 22 further includes a sheet transport mechanism for transporting a recording sheet carrying a toner image thereon to the fixing unit 25. As an alternative to the secondary image transfer unit 22, a non-contact charging unit may be used. With such a non-contact charging unit, a mechanism for transporting a recording sheet carrying a toner image thereon to the fixing unit 25 may be installed separately.

The color copying engine 100 is further provided with a pair of sheet ejection rollers 26 for ejecting a recording sheet carrying a toner image fixed thereon and an output tray 27 for storing recording sheets output from the color copying engine 100.

The color copying engine 100 is further provided with a sheet flipping unit 28 for flipping a recording sheet having a front surface already printed so as to print an image on a back side of the recording sheet in a dual surface copying mode. The sheet flipping unit 28 is arranged under the secondary image transfer unit 22 and the fixing unit 25.

When a color copying is performed with the color copying apparatus 100, a set of originals are placed in a face-up orientation on an original input stacker 30 of the ADF 400. Alternatively, the set of originals can manually be placed sheet by sheet directly on a contact glass 31 of the image scanner 300. To do this, the ADF 400 is lifted up since it has a shell-like openable structure and, after the placement of the original, the ADF 400 is lowered to a closing position.

Then, upon a depress of a start switch (not shown), when the set of originals are placed on the ADF 400, an uppermost original of the set of originals is separated and is transported with a sheet transportation mechanism 32 of the ADF 400 to the contact glass 31 of the image scanner 300 and, subsequently, the image scanner 300 is activated. That is, first and second moving units 33 and 34 of the image scanner 300 slide in a predetermined direction. When the original is manually set on the contact glass 31, the image scanner 300 is immediately activated upon the depress of the start switch. The first moving unit 33 that carries a light source and a mirror (both not shown) causes a light irradiation to move and reflects the light reflected by the original on the contact glass 31. The second moving unit 34 carrying mirrors (not shown) receives the light reflected by the mirror of the first moving unit 33 and reflects the light to a read sensor 35 via an image forming lens 36.

Also, upon the depress of the start switch, the image forming units 11 are activated to form mono-color images in black, yellow, magenta, and cyan on the respective photosensitive drums 12 in the tandem mechanism 10. At the same time, the intermediate transfer belt 13 starts to rotate and sequentially receives the mono-color images at a same position thereof, thereby forming a composite color image.

Further, upon the depress of the start switch, one of sheet supply rollers 42 of the sheet supply station 200 is started to rotate so that a blank recording sheet is moved to a separation roller 45 in a corresponding sheet stocker 44 among a plurality of sheet stockers 44 provided to a sheet bank 43. The separation roller 45 separates the recording sheet from the following sheets and transfers it to a transportation passage 46. Then, the recording sheet is moved to a transportation passage 48 provided to the color copying engine 100 by a plurality of transportation rollers 47. The recording sheet is then stopped by a pair of registration rollers 49.

When a manual insertion is used, a transportation roller 50 is rotated to move a set of recording sheets placed on a manual insertion tray 51 to a pair of separation rollers 52. Then, the pair of separation rollers 52 separate an uppermost recording sheet from the rest of the recording sheets and transfers it to the pair of registration rollers 49 through a transportation passage 53.

After that, the pair of registration rollers 49 are started to rotate in synchronism with the movement of the composite color image carried on the intermediate transfer belt 13 and consequently the recording sheet which is blank is inserted between the intermediate transfer belt 13 and the secondary image transfer unit 22. The composite color image is transferred at one time from the intermediate transfer belt 13 onto the recording sheet by the action of the secondary image transfer unit 22.

After the image transfer, the secondary image transfer unit 22 transports the recording sheet having the composite color image to the fixing unit 25 which then fixes the color image to the recording sheet with heat and pressure. Then, the recording sheet passes through an ejection passage selected by a switch pawl 55 and is ejected to the output tray 27 by the pair of sheet ejection rollers 26. As an alternative, the recording sheet may be headed to the sheet flipping unit 28 by selecting a transportation passage for the dual surface copying mode with the switch pawl 55. In this case, the recording sheet is flipped by the sheet flipping unit 28 and is then transported again to the pair of registration rollers 49 in a face-down orientation. Then, the recording sheet is caused again to pass through the passage between the intermediate transfer belt 13 and the secondary image transfer unit 25 to receive a composite color image on the back surface thereof. After that, the recording sheet with the front and back sides printed passes through the ejection passage selected by the switch pawl 55 and is ejected to the output tray 27 by the pair of sheet ejection rollers 26.

After the image transfer, the intermediate transfer belt 13 further moves to undergo a cleaning of unused toner particles by the cleaning unit 18 and to become ready for a next image transfer process.

Figure 2:
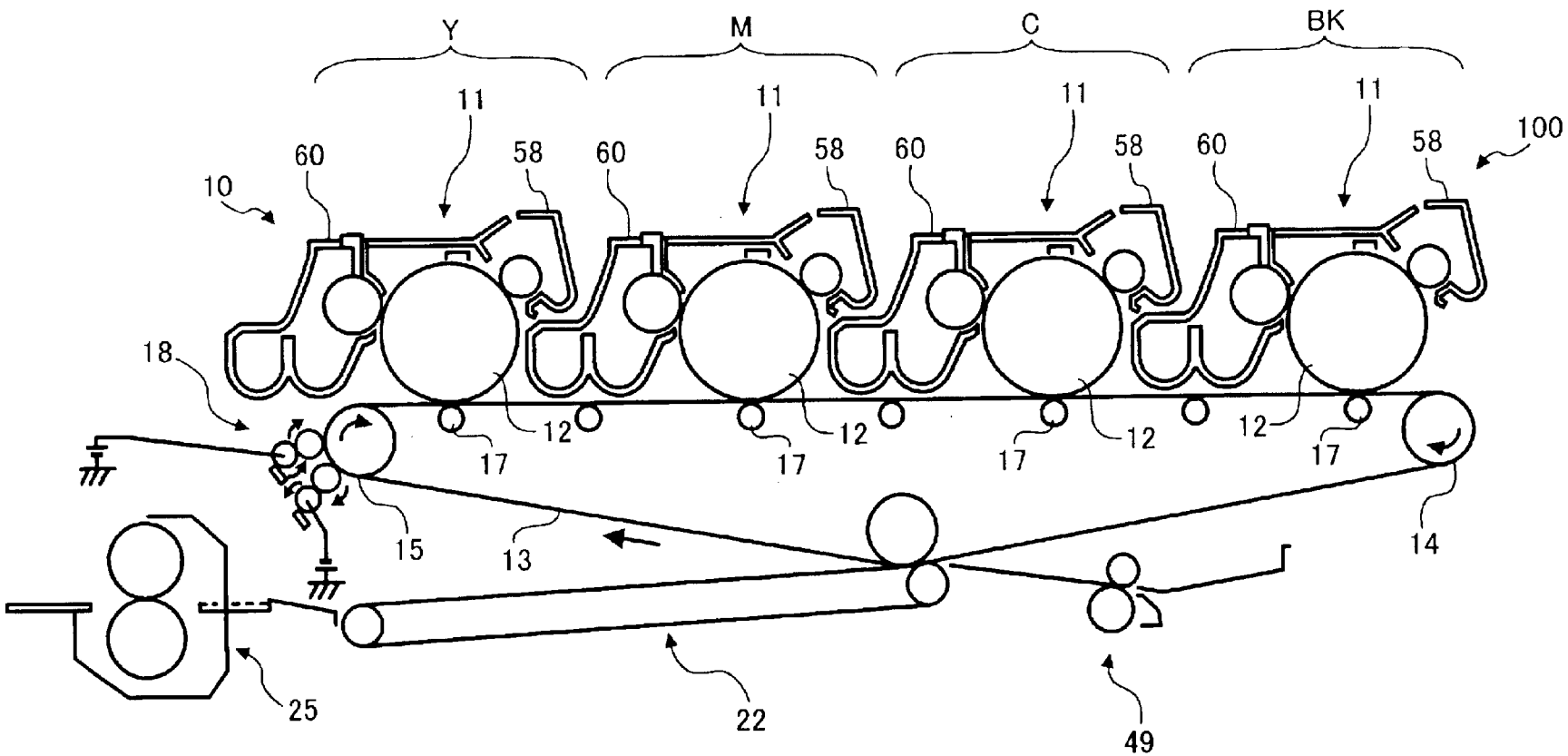
FIG. 2 is a schematic diagram of a major portion of a color copying engine included in the color copying apparatus of FIG. 1.

FIG. 2 shows a major portion of the color copying engine 100 in the color copying apparatus 1. As indicated in FIG. 2, in the tandem mechanism 10, the four image forming units 11 for the colors of Y, M, C, and Bk are arranged in this order in the exemplary embodiment from an upstream side to a downstream side in a moving direction of the intermediate transfer belt 13 in a horizontal area between the rollers 14 and 15 where the four image forming units 11 contact the intermediate transfer belt 13. With this order, a "first copy time" of a copying operation in black can be shortened by a time period corresponding to a length from the most upstream photosensitive drum 12 for the color Y to the most downstream photosensitive drum 12 for the color Bk.

Figure 3:
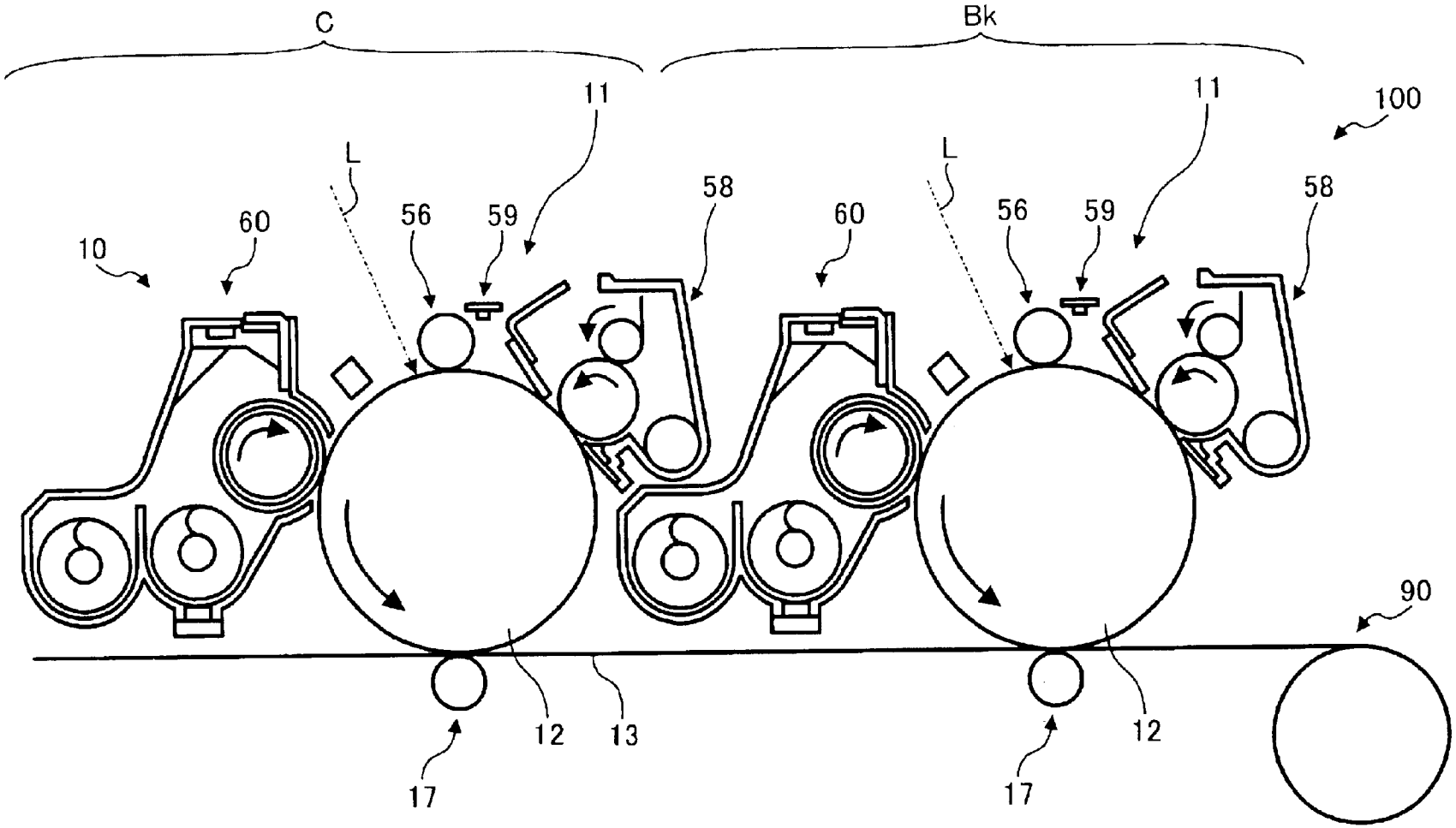
FIG. 3 is a part of the major portion of the color copying engine shown in FIG. 2 with an enlargement.

FIG. 3 enlarges the image forming units 11 for the colors of C and Bk, for example, as a portion of the tandem mechanism 10. As shown in FIG. 3, in the image forming unit 11 for the color of C, for example, the photosensitive drum 12 is surrounded by a charging unit 17, a cleaning unit 58, and a discharging unit 59. A laser light beam L runs to the photosensitive drum 12 between the charging unit 56 and the development unit 60.

Figure 4:
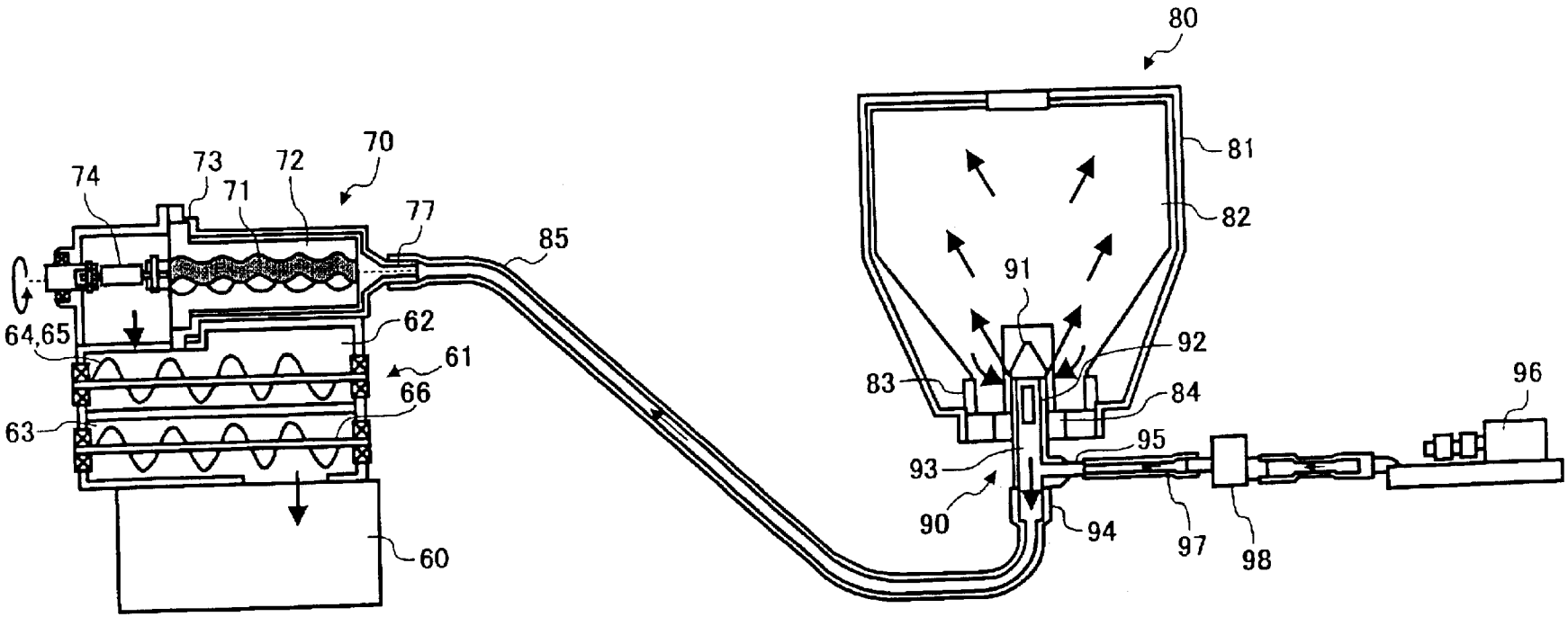
FIG. 4 is a schematic diagram of a toner replenishing mechanism included in the color copying apparatus of FIG. 1.

FIG. 4 shows a toner replenishing mechanism for replenishing the development unit 60 of the image forming unit 11 with toner. In FIG. 4, a toner container 80 contains toner which is transferred to the development unit 60. This toner container 80 is enclosed by an enclosure 110 (see FIG. 8) of the color copying engine 100. The enclosure 110 is provided with a nozzle 90 which is inserted into the toner container 80. When the toner container 80 is exchanged and a new one is inserted downwardly into the enclosure 110, the nozzle 90 is inserted upwardly into the new toner container 80. The nozzle 90 has a tubular structure and is provided with an upper end 91 in a cone-like shape having a pointed top. The upper end 91 is integrated with the nozzle 90 or is adhered to the nozzle 90. The nozzle 90 is provided with an opening 92 for exchanging air and taking in the toner at a position below the upper end 91. The nozzle 90 includes a passage 93 connected to the opening 92 and which is provided with a connection end 94 for connecting a toner transportation tube 85 for transporting toner therethrough. The passage 93 is also provided with an air inlet 95 at a position above the connection end 94.

In this embodiment, an air pump 96 is connected to the air inlet 95 with an air transportation pipe 97. The air transportation pipe 97 is provided with an air valve 98. When the air pump 96 is started to operate and the air valve 98 opens, the air pump 96 discharges the air in a confined jet to inside the toner container 80 from the bottom via the air transportation pipe 97 and the passage 93. The jet air entered inside the toner container 80 agitates the toner and fluidizes the toner in the toner container 80.

The toner container 80 includes an external case 81 serving as a protection cover and a toner sack 82 stored inside the external case 81. The external case 81 has a rectangular transverse section and has an approximately rectangular shape. The toner sack 82 is flexible and exchangeable and is detachably mounted inside the external case 81. The external case 81 is made of a rigid paper material such as a corrugated cardboard or a plastic material, for example, and has an internal space for storing the toner sack 82. The thus-structured toner container 80 is an easy-to-handle container since the flexible toner sack 82 is protected from an external impact with the rigid external case 81.

The toner sack 82 is made of at least one flexible sheet material such as a polyester film, a polyethylene film, or the like having a thickness of the order of from about 80 $\mu$m to 125 $\mu$m. The toner sack 82 has an opening with a ring-shaped portion 83 at a bottom center thereof for discharging the toner. The ring-shaped portion 83 is made of plastic such as polyethylene, nylon, or the like. The opening with the ring-shaped portion 83 is provided with a seal 84 serving as a self-closing valve. The seal 84 includes at least one layer of seal and is made of an elastic material including a sponge foam or the like. The toner sack 82 has a tapered width decreasing as close to the opening with the ring-shaped portion 83 so that the toner cannot remain inside the toner sack 82.

With the thus-structured toner container 80, when the toner container 80 is inserted downwardly into the enclosure 110, the nozzle 90 is inserted upwardly into the toner container 80.

A mechanical shutter may be provided to the toner container 80 to automatically close the opening with the ring-shaped portion of the toner sack 82 when the toner sack 82 is removed from the toner container 80.

Figure 5:
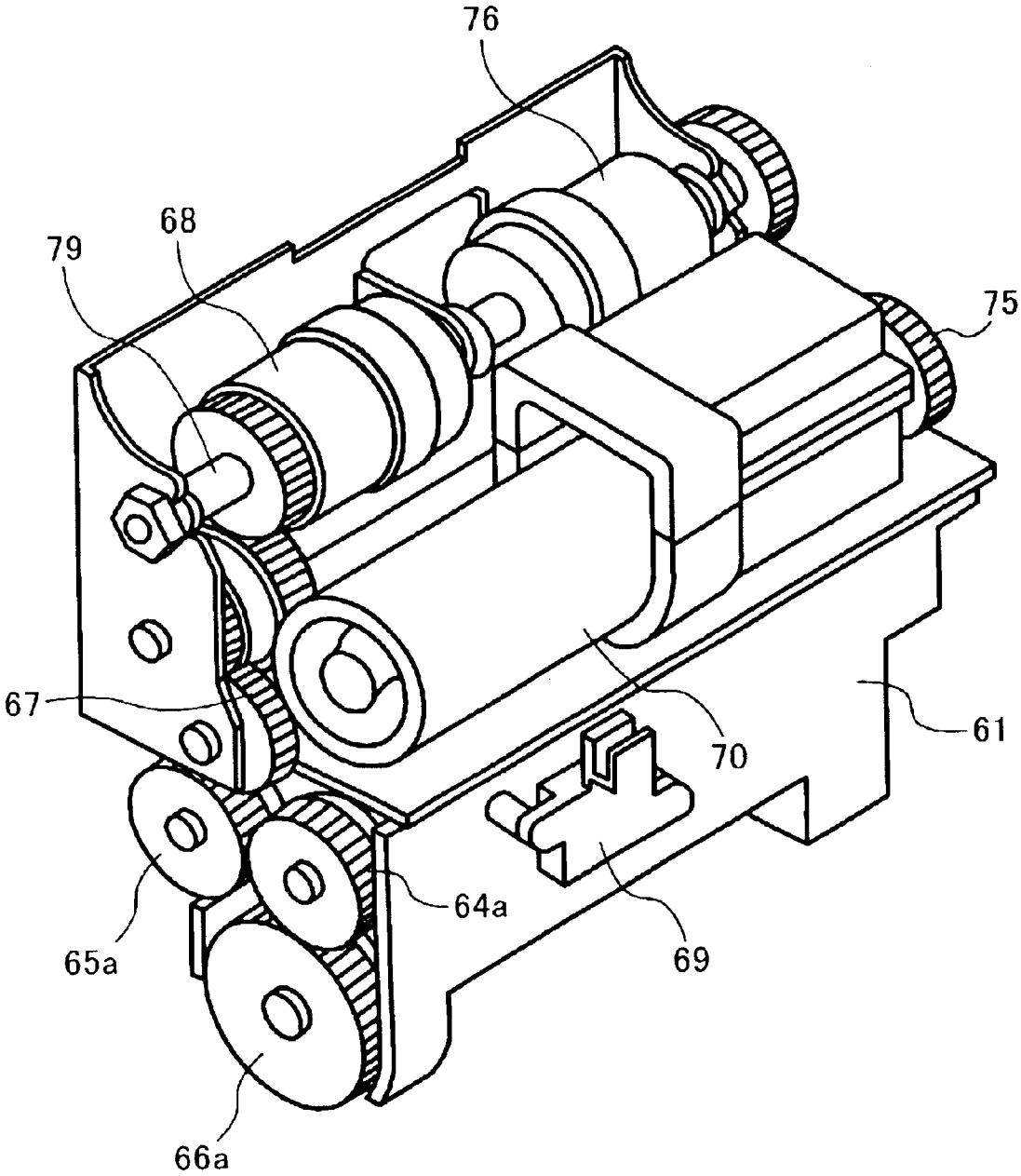
FIG. 5 is a schematic diagram of a toner replenishing mechanism including a powder pump and a sub-hopper.

As shown in FIG. 4, the development unit 60 is provided with a sub-hopper 61 on the top thereof. The toner discharged from the toner container 80 is temporarily stored in the sub-hopper 61. The sub-hopper 61 is provided with a powder pump 70 on the top thereof. The powder pump 70 transports the toner discharged from the toner container 80 to the sub-hopper 61. The powder pump 70 is a pump having a single eccentric screw. The powder pump 70 includes a rotor 71, a stator 72, and a holder 73. The rotor 71 is made of rigid metal and formed in an eccentric screw shape. The stator 72 is made of elastic material such as a rubber and internally has spiral grooves in a two-screw shape. The holder 73 stores the rotor 71 and the stator 72, and is made of the plastic material same as that used for the passage for transporting the toner. The rotor 71 is stored inside the stator 72 and is connected with a driving gear 74 using a pin connector so that the rotor 71 can be driven for rotation by the driving gear 74 and, as a result, the toner inside the stator 72 is transported to the sub-hopper 61 by an action of a negative pressure generated by the rotation of the rotor 71 in the powder pump 70. A gear 75 (see FIG. 5) integrally formed with the driving gear 74 is connected with a first clutch 76 via an idle gear (not shown). By switching the first clutch 76 between connection and disconnection, the operation of the powder pump 70 is controlled. The first clutch 76 and a second clutch 68 (later explained) are provided to a rotation driving shaft 79, as shown in FIG. 5, which is driven by a driving mechanism (not shown).

The holder 73 includes a toner sucking portion 77 at an end thereof, a right end of the holder 73 in FIG. 4, to which the above-mentioned toner transportation tube 85 is connected. The toner transportation tube 85 preferably is a flexible tube having a diameter of from about 4 mm to 10 mm, for example, and is made of a rubber material having a superior anti-toner characteristic, such as polyurethane, nitrile, EPDM (ethylene-propylene-diene-methylene), silicon, or the like. Such toner transportation tube 85 can be bent easily and arbitrarily in any direction.

When the toner discharging portion of the toner container 80 is positioned lower than a toner receiving portion of the sub-hopper 61 in the vertical direction, the toner can smoothly be transported from the toner container by using the above-mentioned powder pump 70.

Figure 6:
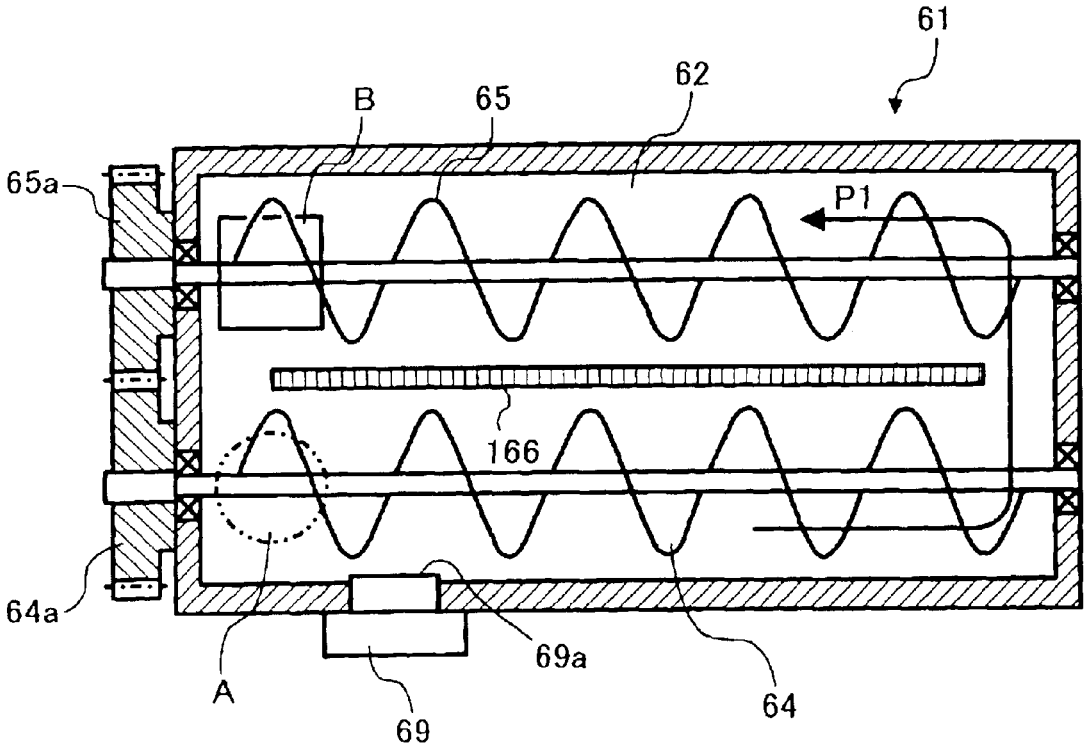
FIG. 6 is a top view of an upper chamber of the sub-hopper.
Figure 7:
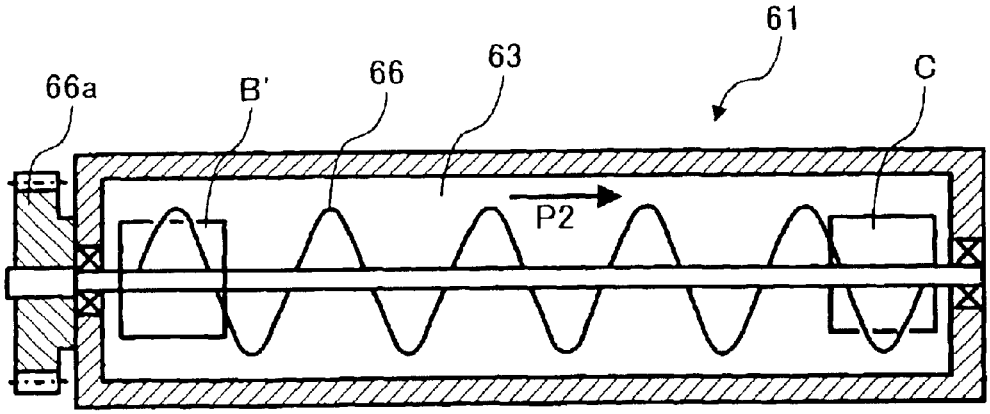
FIG. 7 is a top view of a lower chamber of the sub-hopper.

The sub-hopper 61 is divided into an upper chamber 62 and a lower chamber 63. As shown in FIGS. 6 and 7, where FIG. 6 is a top view of the upper chamber 62 and FIG. 7 is a tope view of the lower chamber 63, the upper chamber 62 has a larger floor area than the lower chamber 63 and is provided with a pair of upper screws 64 and 65 and a partition 166 having two cut ends, left and right cut ends in FIG. 6, where the partition 166 is positioned between the pair of upper screws 64 and 65 and the two cut ends are shorter than an internal width of the upper chamber 62. In FIG. 6, a position A in the upper chamber 62 indicated by a circular mark with a partly-dotted line is a position to which the toner transported by the powder pump 70 is supplied. The toner supplied at the position A is transported within the upper chamber 62 in a direction P1 by the rotations of the upper screws 64 and 65. An opening B in the upper chamber 62 indicated by a square mark with a solid line is an opening connecting inside spaces of the upper chamber 62 and the lower chamber 63. That is, the toner moved along in the direction P1 by the upper screws 64 and 65 is transferred to a region around the connecting opening B and drops down to an inside floor of the lower chamber 63 by its weight through the opening B.

As shown in FIG. 7, the lower chamber 63 is provided with a lower screw 66. A position B' in the lower chamber 63 indicated by a square mark with a solid line is a position to which the toner falls from the upper chamber 62. The toner received at the position B' is transported within the lower chamber 63 in a direction P2 by the rotation of the lower screw 66. An opening C in the lower chamber 63 indicated by a square mark with a solid line is a toner replenishing opening connecting inside spaces of the lower chamber 63 and the development unit 60. That is, the toner moved along in the direction P2 by the lower screw 66 is transferred to a region around the opening C and drops down to an inside floor of the lower chamber 63 by its weight through the opening C.

The sub-hopper 61 is thus structured so that the toner transported by the powder pump 70 is temporarily stored and is transferred to the development unit 60 by the upper screws 64 and 65 and the lower screw 66. That is, these upper screws 64 and 65 and the lower screw 66 serve as a toner transportation mechanism in the sub-hopper 61. In addition, as shown in FIG. 5, the upper screws 64 and 65 and the lower screw 66 are provided with gears 64*a*, 65*a*, and 66*a*, respectively, which are connected via a group of idle gears 67 with a second clutch 68 provided to the driving shaft 79 so that the operations of the upper screws 64 and 65 and the lower screw 66 are controlled by the second clutch 68 which turns on and off.

Further, the sub-hopper 61 is provided with a toner sensor 69 for detecting the toner in the upper chamber 62 when an amount of toner exceeds a predetermined value. The toner sensor 69 is located at a position on a wall near the position A of the upper chamber 62. The toner sensor 69 is a vibration type sensor having a detection surface 69*a*, as shown in FIG. 6, for detecting the toner in the upper chamber 62 when an amount of toner exceeds the predetermined value.

The thus-structured toner replenishing mechanism starts its operation upon a receipt of an instruction signal for replenishing the toner to the development unit 60 from a toner density sensor (not shown), for example. In the toner replenishing operation, the second clutch 68 is turned on to drive the upper screws 64 and 65 and the lower screw 66 so as to supply the toner to the development unit 60 by an amount according to a length of time that the screws are driven. At the same time, the toner sensor 69 monitors the toner amount in the sub-hopper 61. Upon a detection by the toner sensor 69 that the toner amount decreases under a predetermined amount, the powder pump 70 is activated to transport the toner of the toner container 80 to the sub-hopper 61. This process can be performed without the needs of a high accuracy in controlling the amount of the toner replenishment to the sup-hopper 61. Accordingly, the amount of toner to be transported by the powder pump 70 is determined to be greater than an amount of toner to be transferred from the sub-hopper 61 to the development unit 60 by the upper and lower screws.

In addition, if the toner amount detected by the toner sensor 69 maintains under the predetermined amount even with plural times of the toner replenishing operation by the powder pump 70, the toner container 80 is judged as nearly empty, which is referred to as a toner near-end status. When the toner near-end status is detected, a caution for an exchange of the toner container 80 is displayed on an indication member (not shown), for example, of the operation panel 120. When the toner container 80 is not exchanged despite the above-mentioned display of the caution, the image forming operation is prohibited after the execution of the image forming operation a predetermined number of times.

There are three aspects for the above-described toner container 80. A first aspect is an easy-to-handle construction. A second aspect is a large toner storage capacity. A third aspect is to increase the capacity of the black color toner more than other color toners. Since the color copying apparatus 1 uses the powder pump 70 to replenish the development unit 60 with the toner of the toner container 80, the placement of the enclosure 110 for the toner container 80 within the color copying apparatus 1 is highly flexible. However, a careful consideration is required for the placement of the toner container 80 under the circumstances where downsizing of office equipment including the image forming apparatus is an increasingly growing trend.

Figure 8:
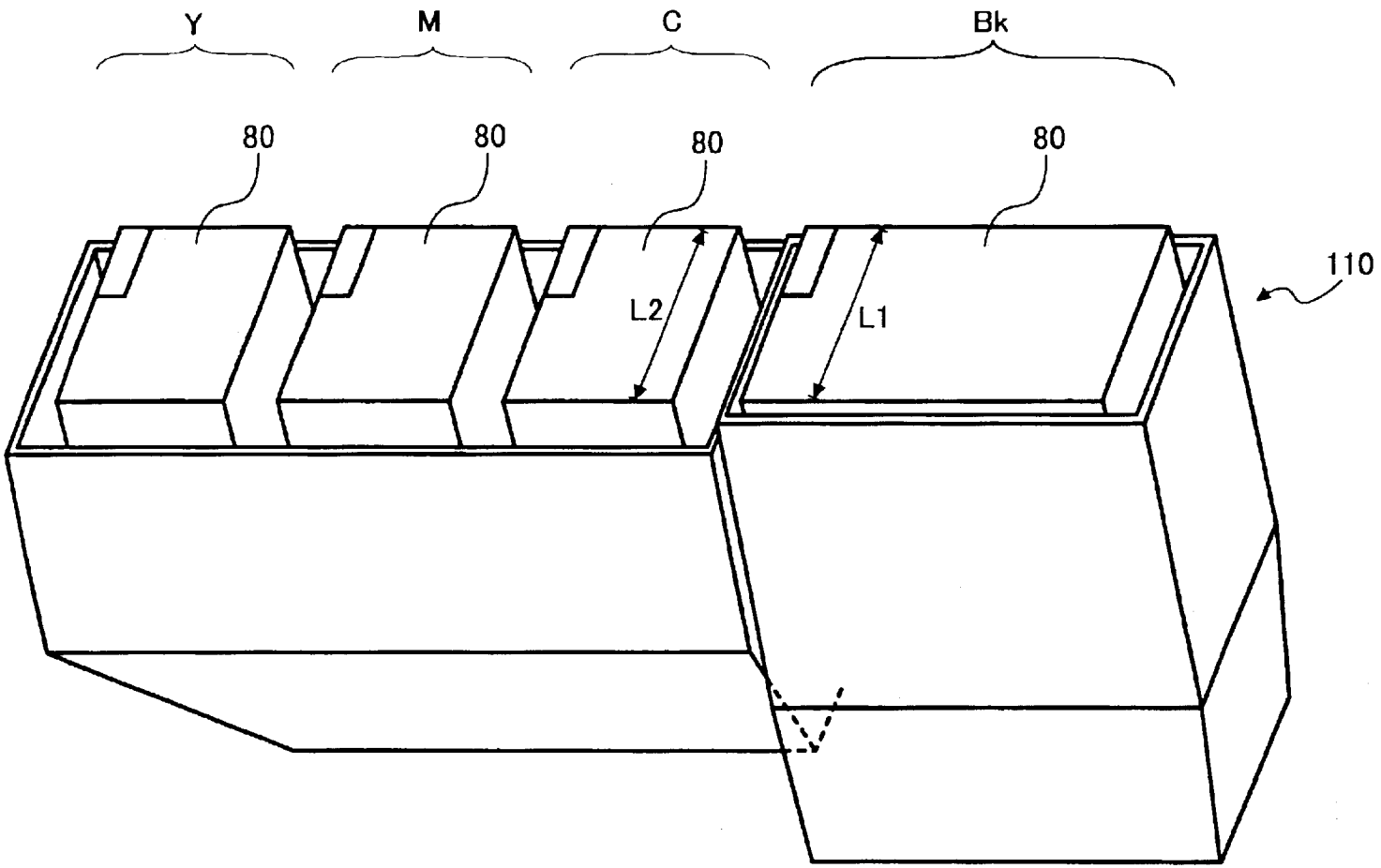
FIG. 8 is a schematic diagram showing an exemplary structure of the enclosure for the toner containers.

In the color copying apparatus 1, the toner containers 80 for the colors of Y, C, and M are formed in a substantially same size and a substantially same rectangular shape having a rectangular transverse section, as shown in FIG. 8. The toner container 80 for the black color is also formed in a similar rectangular shape having a rectangular transverse section. However, the toner container 80 for the black color has a relatively larger size than those for colors. The toner containers 80 for the colors of Y, C, M, and Bk are arranged in line such that a short side of the transverse section of the toner container 80 for Bk and long sides of the transverse sections of the toner containers 80 for other colors are parallel to each other, where a short-side length L1 of the transverse section of the toner container 80 for Bk is set substantially equal to a long-side length L2 of the transverse section of the toner containers 80 for other colors. In this way of arrangement, the toner containers 80 for the colors of Y, C, M, and Bk are aligned without a protrusion in a direction that they are placed. Thus, a space within the color copying apparatus 1 can efficiently be used without making dead spaces (i.e., unutilized space).

As described above, the color copying apparatus 1 uses the air pump 96 to discharge a jet air via the air valve 98 to each of the toner containers 80 so that the toner inside the toner container 80 is fluidized. Then, the fluidized toner is transported from the toner container 80 to the development unit 60 with the powder pump 70. In this structure, the mechanisms of the toner containers 80 for the colors of Y, C, M, and Bk can share a single unit of the air pump 96 using an air pump controller (not shown). That is, the single unit of the air pump 96 is joined to the air passages individually having the air valves 98 for the toner containers 80 and the air pump controller controls timings to open the respective air valves 98 so that the jet air flows to the respective toner containers 80 from one to another.

Figure 8A:
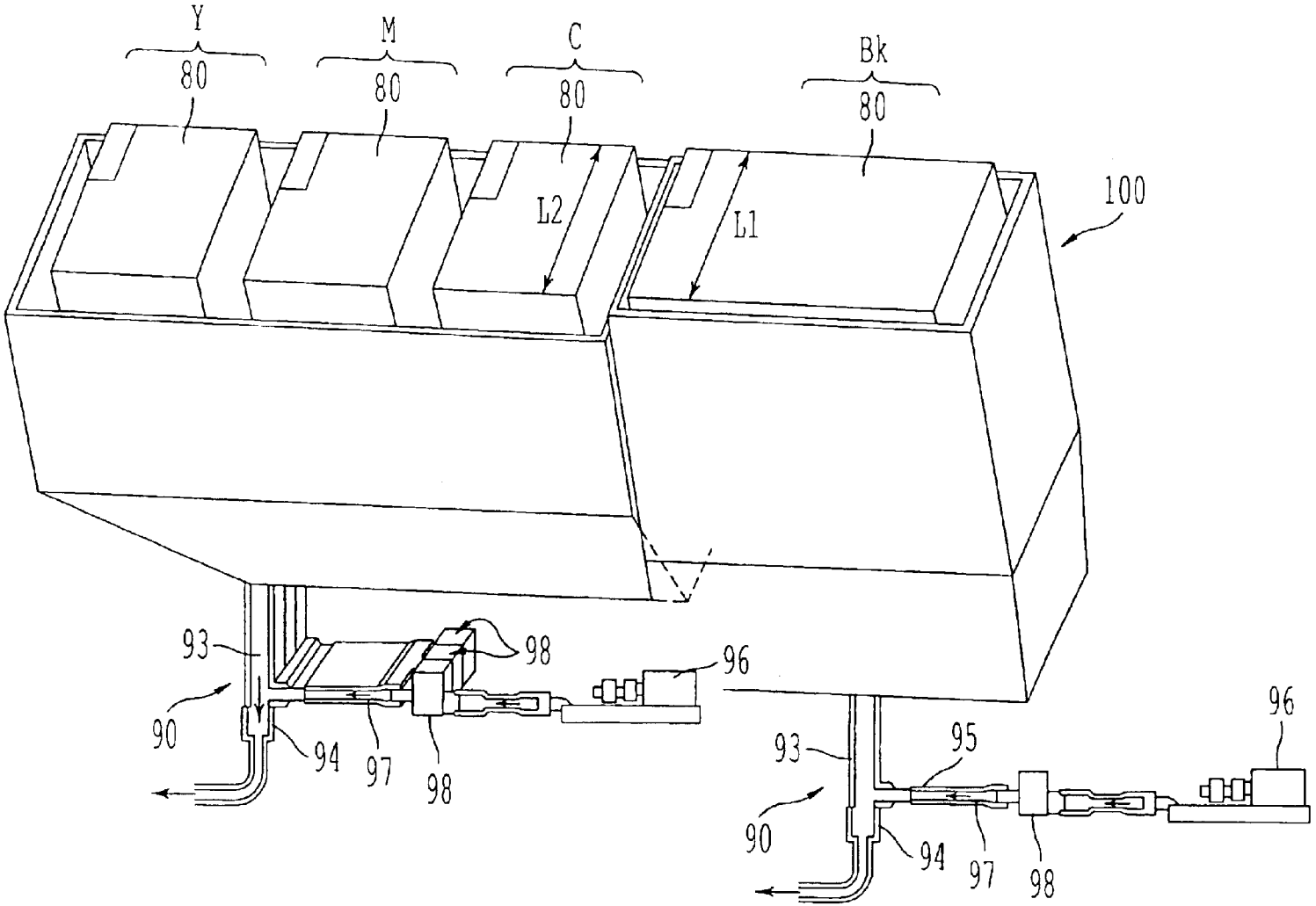
FIG. 8A is a schematic diagram showing an exemplary structure of the enclosure for the toner containers with an air pump for the larger container and separate air pump for the other containers.

However, the black toner may need a greater amount of the jet air than others since the amount of the black toner is greater than others and consequently it may easily become flocculated. Therefore, the above-mentioned air pump controller preferably controls the timings so as to provide a greater amount of the jet air to the toner container 80 for Bk than to others. In addition, an air pressure of the jet air discharged to the black toner may preferably be adjusted to be higher than the air pressures for others so that the jet air is prevented from being pressed backwardly towards the air pump 96 by the high pressure of the black toner having a greater mass as a whole. This leads to an alternative that a unit of the air pump 96 is provided for the toner container 80 for Bk separately from the air pump 96 for other colors as shown in FIG. 8A. With such a separate unit of the air pump 96, the airjet for the black toner can easily be adjusted to have suitable values in amount and pressure. Thus, a degradation in the toner transportation capability due to the difference of the toner capacity between the black toner and others can be avoided.

Figure 9:
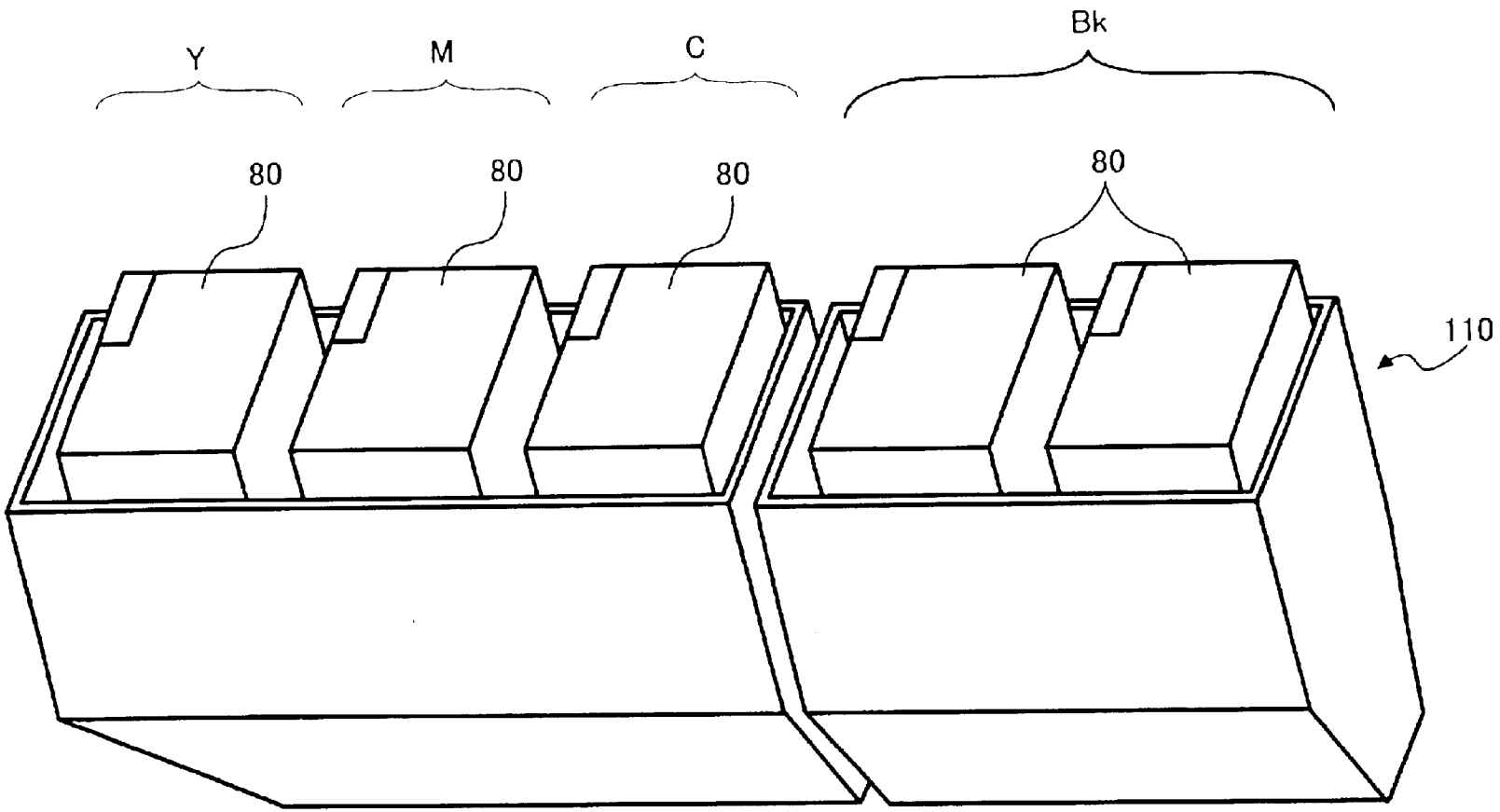
FIG. 9 is a schematic diagram showing another exemplary structure of the enclosure for the toner containers.

FIG. 9 shows the toner containers 80 configured to have a substantially same size, as an alternative to the above-described size of the black toner container shown in FIG. 8. As shown in FIG. 9, all the toner containers 80 for the colors of Y, C, M, and Bk have a substantially same size, and two black toner containers are provided. With this configuration, the manufacturing cost which is increased due to the difference in size between the containers is decreased while maintaining the large capacity of the black toner, that is, avoiding an increase of an exchanging frequency with respect to the black toner container. In this case, the toner containers 80 for the colors of Y, C, M, and Bk are aligned such that long sides of transverse sections of these toner containers 80 are placed parallel to each other. Thereby, a space within the color copying apparatus 1 can efficiently be used without creating a dead space.

Further, in FIG. 9, when one of the two toner containers 80 for the black color becomes in the toner near-end status, the color copying apparatus 1 can continue the image forming operation without stopping in the middle of the operation by using the other one of the two toner containers 80 for the black color. Moreover, after one of the two black toner containers runs out, this container can be exchanged at any time before the other one of the black toner containers runs out. Thus, there is no need to stop the image forming operation because of the exchange of the black toner container. Naturally, a total number of times to exchange the toner containers is accordingly reduced.

In the above-described case that the two black toner containers 80 are provided, each of the black toner containers 80 is provided with a unit of the toner replenishing mechanism of FIG. 4. However, the development unit 60 for the black color is a single unit and therefore a joint connection is needed to joint two flows of the black toner transported from the two units of the toner containers 80 for Bk. Such joint connection is preferably provided before the powder pump 70. In order to selectively used the two flows of the black toner, each passage is provided with an open and close mechanism such as a valve for controlling the flow of the black toner.

Numerous additional modifications and variations are possible in light of the above teachings. It is therefore to be understood that within the scope of the appended claims, the disclosure of this patent specification may be practiced otherwise than as specifically described herein.

This specification is based on Japanese Patent Application No. JPAP2002 110526, filed on Apr. 12, 2002 in the Japanese Patent Office, the entire contents of which are incorporated by reference herein.

What is claimed is:

1. An image forming apparatus, comprising:

plural sets of image forming mechanisms, each set comprising:

an image carrying member configured to carry an electrostatic latent image thereon;

a development mechanism configured to develop the electrostatic latent image formed on the image carrying member into a visual image; and a toner storage detachably installed in the apparatus and configured to store toner therein, and an intermediate transfer member configured to sequentially receive toner images formed by the plurality of image forming mechanisms into a composite toner image and to transfer the composite toner image to a recording sheet, wherein a plurality of the toner storages have an approximately rectangular shape having a rectangular transverse section, at least one of the plurality of the toner storages has a greater toner capacity than others of the plurality of the toner storages, and a length of a short side of the rectangular transverse section of the at least one of the plurality of the toner storages having the greater toner capacity is approximately equal to lengths of long sides of the rectangular transverse sections of the others of the plurality of the toner storages.

2. The image forming apparatus as defined in claim 1, wherein the plurality of the toner storages are aligned such that the short side of the rectangular transverse section of the at least one of the plurality of the toner storages and the long sides of the rectangular transverse sections of the others of the plurality of the toner storages are arranged parallel to each other.

3. The image forming apparatus as defined in claim 1, wherein each of the plurality of the image forming mechanisms further comprises a toner replenishing mechanism comprising:

a screw pump transporting with a negative pressure, toner from the corresponding toner storage to the corresponding development mechanism, wherein each of the at least one of the plurality of the toner storages having the greater toner capacity is provided with a single air pump discharging a jet air to an inside of the corresponding toner storage and the others of the plurality of the toner storages are provided with a common air pump discharging a jet air to an inside of the toner storages.

4. The image forming apparatus as defined in claim 1, wherein the toner storage included in the at least one of the plurality of the toner storages having the greater toner capacity is divided into a plurality of toner containers.

5. The image forming apparatus as defined in claim 4, wherein the plurality of toner containers divided from the toner storage and the others of the plurality of the toner storages have a substantially common size and an approximately rectangular shape having a rectangular transverse section.

6. An image forming apparatus, comprising:

plural sets of image forming means for forming an image, each set comprising:

carrying means for carrying an electrostatic latent image thereon;

developing means for developing the electrostatic latent image formed on the carrying means into a visual image; and storing means for storing toner, detachably installable in the apparatus, and intermediate transferring means for sequentially receiving toner images formed by the plurality of image forming mechanisms into a composite toner image and transferring the composite toner image to a recording sheet, wherein a plurality of the storing means have an approximately rectangular shape having a rectangular transverse section, at least one of the plurality of the storing means has a greater toner capacity than others of the plurality of the storing means, and a length of a short side of the rectangular transverse section of the at least one of the plurality of the storing means having the greater toner capacity is approximately equal to lengths of long sides of the rectangular transverse sections of the others of the plurality of the storing means.

7. The image forming apparatus as defined in claim 6, wherein the plurality of the storing means are aligned such that the short side of the rectangular transverse section of the at least one of the plurality of the storing means and the long sides of the rectangular transverse sections of the others of the plurality of the storing means are arranged parallel to each other.

8. The image forming apparatus as defined in claim 6, wherein each of the plurality of the image forming means further comprises toner replenishing means comprising:

transporting means for pumping with a negative pressure toner from the corresponding storing means to the corresponding developing means, wherein each of the at least one of the plurality of the storing means having the greater toner capacity is provided with air discharging means for discharging a jet air to an inside of the corresponding storing means and the others of the plurality of the storing means are provided with common air discharging means for discharging a jet air to an inside of the storing means.

9. The image forming apparatus as defined in claim 6, wherein the storing means included in the at least one of the plurality of the storing means having the greater toner capacity is divided into a plurality of toner containing means.

10. The image forming apparatus as defined in claim 9, wherein the plurality of toner containing means divided from the storing means and the others of the plurality of the storing means have a substantially same size and an approximately rectangular shape having a rectangular transverse section.

11. A method of making an image forming apparatus, comprising the steps of:

providing a plural sets of image forming mechanisms, each set including:

an image carrying member configured to carry an electrostatic latent image thereon;

a development mechanism configured to develop the electrostatic latent image formed on the image carrying member into a visual image; and a toner storage detachably installed in the apparatus and configured to store toner therein, and placing an intermediate transfer member configured to sequentially receive toner images formed by the plurality of image forming mechanisms into a composite toner image and to transfer the composite toner image to a recording sheet, wherein a plurality of the toner storages have an approximately rectangular shape having a rectangular transverse section, at least one of the plurality of the toner storages has a greater toner capacity than others of the plurality of the toner storages, and a length of a short side of the rectangular transverse section of the at least one of the plurality of the toner storages having the greater toner capacity is approximately equal to lengths of long sides of the rectangular transverse sections of the others of the plurality of the toner storages.

12. The method as defined in claim 11, wherein the plurality of the toner storages are aligned such that the short side of the rectangular transverse section of the at least one of the plurality of the toner storages and the long sides of the rectangular transverse sections of the others of the plurality of the toner storages are arranged parallel to each other.

13. The method as defined in claim 11, wherein each of the plurality of the image forming mechanisms further comprises a toner replenishing mechanism comprising:

a screw pump transporting with a negative pressure the toner from the corresponding toner storage to the corresponding development mechanism, wherein each of the at least one of the plurality of the toner storages having the greater toner capacity is provided with a single air pump discharging a jet air to an inside of the corresponding toner storage and the others of the plurality of the toner storages are provided with a common air pump discharging a jet air to an inside of the toner storages.

14. The method as defined in claim 11, wherein the toner storage included in the at least one of the plurality of the toner storages having the greater toner capacity is divided into a plurality of toner containers.

15. The method as defined in claim 14, wherein the plurality of toner containers divided from the toner storage and the others of the plurality of the toner storages have a substantially same size and an approximately rectangular shape having a rectangular transverse section.

* * * * *